US012376725B2

(12) United States Patent
Weber et al.

(10) Patent No.: US 12,376,725 B2
(45) Date of Patent: Aug. 5, 2025

(54) DISHWASHER, METHOD FOR OPERATING A DISHWASHER, AND COMPUTER PROGRAM PRODUCT

(71) Applicant: BSH Hausgeräte GmbH, Munich (DE)

(72) Inventors: Ulrike Weber, Diebach (DE); Bernd Eisenbart, Holzheim (DE); Vitus Hörmann, Glött (DE)

(73) Assignee: BSH Hausgeräte GmbH, Munich (DE)

( * ) Notice: Subject to any disclaimer, the term of this patent is extended or adjusted under 35 U.S.C. 154(b) by 322 days.

(21) Appl. No.: 18/010,528

(22) PCT Filed: Jun. 10, 2021

(86) PCT No.: PCT/EP2021/065595
§ 371 (c)(1),
(2) Date: Dec. 15, 2022

(87) PCT Pub. No.: WO2022/002557
PCT Pub. Date: Jan. 6, 2022

(65) Prior Publication Data

US 2023/0284862 A1 Sep. 14, 2023

(30) Foreign Application Priority Data

Jun. 30, 2020 (DE) ..... 10 2020 208 139.5

(51) Int. Cl.
*A47L 15/00* (2006.01)
*A47L 15/42* (2006.01)

(52) U.S. Cl.
CPC ..... *A47L 15/0028* (2013.01); *A47L 15/0047* (2013.01); *A47L 15/4221* (2013.01); *A47L 2401/14* (2013.01); *A47L 2501/05* (2013.01)

(58) Field of Classification Search
CPC ..... A47L 15/4221; A47L 15/0047; A47L 15/0028
See application file for complete search history.

(56) References Cited

U.S. PATENT DOCUMENTS

2010/0121497 A1 5/2010 Heisele
2015/0305592 A1 10/2015 Pers
(Continued)

FOREIGN PATENT DOCUMENTS

CH 694495 A5 2/2005
DE 102017217989 A1 4/2019
WO 2006033027 A1 3/2006

OTHER PUBLICATIONS

Report of Examination DE 102020208139.5 dated Jun. 15, 2021.
International Search Report PCT/EP2021/065595 dated Aug. 20, 2021.

*Primary Examiner* — Michael E Barr
*Assistant Examiner* — Kevin G Lee
(74) *Attorney, Agent, or Firm* — Michael E. Tschupp; Andre Pallapies; Brandon G. Braun

(57) ABSTRACT

A dishwasher includes a pump facility to selectively supply washing liquor to first and second spray apparatuses, an intensive spray apparatus assigned to the first or second spray apparatus and brought into an activated or deactivated state by a switch valve, and a control apparatus for carrying out a washing program and for detecting a first pump flow while the first spray apparatus is supplied with washing liquor and detecting a second pump flow while the second spray apparatus is supplied with washing liquor, so as to form a current differential value as a function of the first and second pump flows and to ascertain a current switch state of the intensive spray apparatus as a function of the current differential value, a number of stored earlier differential values and a predetermined class differential value. The control apparatus adapts the washing program as a function of the current switch state.

17 Claims, 5 Drawing Sheets

(56) References Cited

U.S. PATENT DOCUMENTS

| | | | | |
|---|---|---|---|---|
| 2015/0359405 | A1 | 12/2015 | Kim | |
| 2016/0278608 | A1 | 9/2016 | Edenius | |
| 2019/0174989 | A1 | 6/2019 | Persson | |
| 2021/0145242 | A1* | 5/2021 | Hörmann | A47L 15/4221 |

* cited by examiner

DISHWASHER, METHOD FOR OPERATING A DISHWASHER, AND COMPUTER PROGRAM PRODUCT

CROSS-REFERENCES TO RELATED APPLICATIONS

This application is the U.S. National Stage of International Application No. PCT/EP2021/065595, filed Jun. 10, 2021, which designated the United States and has been published as International Publication No. WO 2022/002557 A1 and which claims the priority of German Patent Application, Serial No. 10 2020 208 139.5, filed Jun. 30, 2020, pursuant to 35 U.S.C. 119(a)-(d).

The contents of International Application No. PCT/EP2021/065595 and German Patent Application, Serial No. 10 2020 208 139.5 are incorporated herein by reference in their entireties as if fully set forth herein.

BACKGROUND OF THE INVENTION

The present invention relates to a dishwasher, a method for operating a dishwasher, and a computer program product.

Dishwashers are known which have different spray apparatuses, wherein it is possible for example for a user to switch manually between the different spray apparatuses. To this end, one of the spray apparatuses can be embodied to provide a special washing zone which achieves a particularly high cleaning performance or is configured for specifically shaped items to be washed. US 2015/0250374 A1 therefore shows a dishwasher in which a bottle washing facility can be connected by means of a manually switchable valve. WO 2015/090433 discloses a similar apparatus, in which a special holder for items to be washed having integrated spray nozzles can be supplied with washing liquor, so that on the one hand washing liquor is directed in a targeted manner by means of the integrated spray nozzles onto the items to be washed, and on the other hand the items to be washed are held securely by the holder during a washing cycle.

Here, the switch position of such additional spray facilities can affect the cleaning result of the dishwasher if for example insufficient washing liquor is present in the washing circuit to supply all spray facilities with washing liquor or because a fluid pressure of the washing liquor is too low. It is therefore advantageous if the switch position of the additional spray facility is known, so that this can be responded to in an appropriate manner. It is however labor-intensive and expensive to arrange a corresponding sensor in the dishwasher interior of such a dishwasher. Furthermore, such a sensor would be fault-prone on account of the conditions in the dishwasher interior.

DE 10 2007 017 274 A1 describes a method for identifying the position of a closure element in a water switch of a dishwasher. Here, a signal value of the circulating pump is detected and compared with a stored signal value which corresponds to a reference position of the closure element. In this way, it is possible to identify when the closure element is in the reference position. WO 2014/071980 A1 discloses a method for identifying the switch position of an additional spray facility, which is based on a measurement of a pump flow at different rotational speeds of the circulating pump.

DE 10 2017 206 947 A1 discloses a dishwasher in which, based on a difference in the pump flow of a circulating pump between a supply of washing liquor to a first spray apparatus and a supply of washing liquor to a second spray apparatus, it is ascertained whether a connectable intensive washing zone is activated or deactivated.

DE 10 2017 217 989 A1 discloses a dishwasher in which a washing program is adapted as a function of a connected intensive washing zone.

BRIEF SUMMARY OF THE INVENTION

Against this background, an object of the present invention is to provide an improved dishwasher.

According to a first aspect, a dishwasher, in particular a household dishwasher, with a control apparatus for carrying out a washing program for washing items to be washed arranged in a washing compartment of the dishwasher is proposed. The dishwasher comprises a first spray apparatus and a second spray apparatus which can selectively be supplied with washing liquor via a pump facility in order to embody a respective washing zone, and in addition an intensive spray apparatus, which is assigned to the first or the second spray apparatus and which can be brought into an activated or a deactivated state by means of a switch valve. The control apparatus is configured to detect a first pump flow while the first spray apparatus is being supplied with washing liquor and to detect a second pump flow while the second spray apparatus is being supplied with washing liquor, and to form a current differential value as a function of the detected first and second pump flow. The control apparatus is further configured to ascertain a current switch state of the intensive spray apparatus as a function of the current differential value, a number of stored earlier differential values, and a predetermined class differential value. Furthermore, the control apparatus is configured to adapt the washing program as a function of the ascertained current switch state.

This dishwasher has the advantage that it is possible to identify on the basis of the pump flow, without an additional sensor, whether or not the intensive spray apparatus is activated, and to adapt the washing program accordingly. By reference being made to earlier differential values instead of fixedly predetermined values during the ascertainment, a slow change in the differential values, which can be caused for example on account of an aging of components and/or a soiling of hydraulic lines and the like, is taken into account automatically. This means that an incorrect identification on account of such a slow change is avoided. It is also possible to avoid an incorrect ascertainment on account of an unreliable power network in which a network voltage has significant fluctuations.

The intensive spray apparatus is configured to embody an intensive washing zone or intensive spraying zone. The intensive spray apparatus can be arranged for example on one of the receptacles for items to be washed. The intensive spray apparatus can however also be positioned on side walls of the dishwasher cavity, on a ceiling of the same, or on a rear wall of the dishwasher cavity. The first and the second spray apparatus are preferably embodied as spray arms. This is not however obligatory.

By means of the switch valve, the intensive spray apparatus can be selectively brought into an activated switch state in which the intensive spray apparatus is fluidically connected to the assigned spray apparatus, or into a deactivated switch state in which the intensive spray apparatus is fluidically disconnected from the assigned spray apparatus. A "switch valve" is understood here to mean in particular a valve which enables the intensive spray apparatus to switch back and forth between the activated state and the deactivated state without it being possible for intermediate positions to be assumed. The switch valve is preferably a valve which is to be actuated manually. Alternatively, the switch valve can however also be actuated electrically. The switch valve can be a solenoid valve, for example. The switch state can thus have precisely one of precisely two states.

In embodiments, the first and the second spray apparatus are connected to the pump facility with the aid of a shared supply line. Alternatively, the two spray apparatuses can also have a separate supply line in each case.

In particular, the shared supply line branches, wherein at the branch a water switch can be provided by means of which a washing liquor can selectively be guided to the first or the second spray apparatus. Depending on how the water switch is embodied, it can have two to four switch positions. In a first switch position, only the first spray apparatus is supplied with washing liquor. In a second switch position, only the second spray apparatus is supplied with washing liquor. These two switch positions must always be provided. In a third switch position both spray apparatuses are supplied with washing liquor, and in a fourth switch position no spray apparatus is supplied with washing liquor. The third and fourth switch position are optional. The water switch is controllable in particular by the control apparatus.

The pump facility is preferably a circulating pump of the dishwasher. The pump facility can be provided in particular on a pump sump of a dishwasher cavity. The pump sump is in turn arranged on a base of the dishwasher cavity. Here, the pump facility "supplying" the spray apparatuses with washing liquor means that the pump facility pumps the washing liquor through a hydraulic system of the respective spray apparatus. The pump facility can, but does not have to be, part of the hydraulic system.

Here, washing liquor is understood to mean in particular any fluid which is used to wash the items to be washed. This can be fresh water, water mixed with a cleaning agent, or water mixed with dissolved dirt. The washing liquor is preferably replaced several times during a washing program. In individual program substeps of the washing program, the washing liquor is preferably brought by a heating facility to a certain temperature, which lies for example in the range between 35° C.-70° C.

The two spray apparatuses differ from one another in particular in a volumetric flow of washing liquor which is sprayed at a certain pressure through the respective spray apparatus in the washing compartment. This results in a difference in the pump flow received by the pump facility when the first or the second spray apparatus is supplied with washing liquor. This difference depends in particular on how a respective hydraulic system of the spray apparatus is embodied. Hydraulic system is understood for example to mean the entire supply line from the pump facility through to the spray apparatus and the spray apparatus itself. The greater a flow resistance in a hydraulic system, the lower a volumetric flow at a certain pressure. The pressure depends in particular on the rotational speed of the pump facility. When the intensive spray apparatus is activated, the flow resistance is reduced for the respective hydraulic system, as a result of which the volumetric flow is increased and thus also the pump flow in comparison to the deactivated intensive spray apparatus.

A characteristic difference results in the pump flow between the activated and the deactivated intensive spray apparatus, which is described here by the class differential value. Here, the class differential value can be a variable relating to any scale; it does not have to be a flow value. The class differential value is for example fixedly determined. In embodiments, a calibration measurement of the class differential value can also be provided by the pump flow being detected when the intensive spray apparatus is activated and when the intensive spray apparatus is deactivated, wherein the difference between the two flow values is ascertained and defined as the class differential value.

By the difference between the detected values of the pump flow being formed when the first and the second spray apparatus are supplied, effects leading to a change in the pump flow in both spray apparatuses, such as a fluctuating input voltage or the like, are compensated. The first pump flow and the second pump flow are preferably detected in quick succession, for example directly before a switchover from the first spray apparatus to the second spray apparatus and directly after the switchover.

During each washing program cycle, the control apparatus detects the two values of the pump flow and forms the respective current differential value therefrom. It stores this for example in a memory unit so that it is available during subsequent washing program cycles. When two of these variables are known, the third variable can be determined on the basis of the relationship between the differential value, the class differential value and the present switch state.

To ascertain the current switch state, the control apparatus compares for example the current differential value with a number of stored earlier differential values. Here, the switch state is preferably known for at least one of the stored earlier differential values. This earlier differential value can then serve as a reference value or starting value. When the current differential value lies close to the reference value, then the switch state of the reference value is ascertained as the current switch state. When the current differential value differs from the reference value by approximately the class differential value, the other switch state is ascertained as the current switch state.

The control apparatus can be implemented as hardware and/or software. If implemented as hardware, the control apparatus can be embodied for example as a computer or microprocessor. If implemented as software, the control apparatus can be embodied as a computer program product, as a function, as a routine, as part of a program code or as an executable object.

The control apparatus is configured to adapt the washing program of the household dishwasher as a function of the ascertained switch state of the intensive spray apparatus, for example such that a pressure in a hydraulic circuit of the household dishwasher in the deactivated switch state corresponds at least to a pressure in the hydraulic circuit in the activated switch state.

In particular a volumetric flow in the hydraulic circuit in the deactivated switch state also corresponds at least to a volumetric flow in the hydraulic circuit in the activated switch state. Furthermore, the temperatures can also be increased during the washing program for an improved washing performance. The actuation times, for example during upper basket operation, can also be increased. This likewise improves the washing performance. Each of the aforementioned modifications can be made in each section of the washing program, for example during pre-rinsing, intermediate rinsing, cleaning or rinsing with rinse-aid.

According to one embodiment of the dishwasher, the intensive spray apparatus is in a predetermined switch state the first time the washing program is carried out with the dishwasher.

This ensures that a reference value is available for ascertaining the current switch state. Reference can also be made here to a calibration wash cycle. For the calibration wash cycle, it is provided for example that the intensive spray apparatus is deactivated. To this end, a soluble plug is preferably arranged in the supply line to the intensive spray apparatus, which dissolves during and/or after initial use. Alternatively, a user dialog can be provided which instructs the user to place the intensive spray apparatus into the predetermined switch state.

If during a subsequent washing program cycle a current differential value is ascertained which differs from the earlier differential value by the predetermined class differential value, it is ascertained that the intensive spray apparatus is in the other switch state.

According to a further embodiment of the dishwasher, the control apparatus is configured to store at least one earlier differential value with a switch state assigned to the earlier differential value.

According to a further embodiment of the dishwasher, the control apparatus is configured to store the formed current differential value together with the ascertained current switch state.

According to a further embodiment of the dishwasher, the control apparatus is configured to ascertain the current switch state on the basis of the stored earlier differential values of the last N washing programs carried out, wherein N is a natural number from the range [0,100].

Several earlier washing program cycles are preferably taken into consideration. By not just a single washing program cycle being taken into consideration, it can be excluded that all subsequent ascertainments are incorrect on account of a single outlier. In preferred embodiments, N=25. The number N can also be variable, in particular the number for a new dishwasher which has not yet been used frequently can increase with each use until the preferred number is reached.

In particular the first time the washing program is carried out, in other words during the first use of the dishwasher, N=0.

According to a further embodiment of the dishwasher, the control apparatus is configured to ascertain a virtual differential value on the basis of the current differential value and the ascertained current switch state. The virtual differential value corresponds in the activated switch state of the intensive spray apparatus to a difference between the current differential value and the predetermined class differential value, and corresponds in the deactivated switch state of the intensive spray apparatus to a sum of the current differential value and the predetermined class differential value. The control apparatus is further configured to store a value pair comprising the current differential value and the ascertained virtual differential value.

One value pair is therefore available for each washing program cycle. This can be advantageous during a later comparison of a current differential value with earlier differential values, depending on the comparison method used.

According to a further embodiment of the dishwasher, the predetermined class differential value for ascertaining the virtual differential value comprises a first value for the activated switch state and a second value for the deactivated switch state.

For example, the first value of the class differential value is used to ascertain the virtual differential value with respect to a current differential value on the basis of which the activated switch state was ascertained, and the second value of the class differential value is used to ascertain the virtual differential value with respect to a current differential value on the basis of which the deactivated switch state was ascertained. In this way, a difference resulting for example from the switching direction can be taken into consideration.

According to a further embodiment of the dishwasher, the control apparatus is configured to ascertain the current switch state as a function of a number of stored value pairs, wherein the control apparatus is configured to form an upper mean value which is a mean value of the respectively higher values of the number of stored value pairs and to form a lower mean value which is a mean value of the respectively lower values of the number of stored value pairs, and to compare the current differential value with the upper mean value and the lower mean value.

Here, the switch state that the higher values have is also assigned to the upper mean value. Likewise, the switch state that the lower values have is assigned to the lower mean value.

A distance between the current differential value and the upper and the lower mean value is ascertained, for example. The current switch state is ascertained as that switch state which is assigned to the mean value for which the shorter distance is ascertained.

According to a further embodiment of the dishwasher, the control apparatus is configured to ascertain the current switch state as a function of a selection of stored value pairs, wherein the control apparatus is configured to ascertain a number of nearest values of all values comprised by the selection of stored value pairs and to ascertain the switch state of a respective value of the number of nearest values.

This method can be referred to as the nearest-neighbor method. The selection of stored value pairs comprises for example the value pairs of the last five washing program cycles. The selection thus comprises ten individual values in total, the respective switch state of which is known.

The nearest values are those values with the smallest difference in comparison with the current differential value. An odd number of nearest values is preferably ascertained so as to exclude a deadlock situation. In preferred embodiments, 3, 5 or 7 nearest values are ascertained. Advantageously, at most only as many nearest values are ascertained as are comprised by the number of value pairs. If there is a smaller number of stored value pairs than are provided for the selection, then preferably the next smallest odd number of stored value pairs is used. For example, it is provided that the selection comprises five value pairs but only four stored value pairs are available. Then only three of the stored value pairs are used for the selection.

The switch state is ascertained as the switch state which occurs most frequently in the nearest values.

In a case in which a final nearest value is still sought for the number and two values with the same distance from the current differential value are found, it can be defined for example that the older value is taken into consideration. If both values also have the same age, for example the value which corresponds to the deactivated switch state can be taken into consideration, or vice versa. Alternatively, in such a case it is possible to fall back to the next smallest odd number of values.

According to a further embodiment of the dishwasher, the switch valve can be operated manually by a user of the dishwasher to set the switch state of the intensive spray apparatus.

In particular, the switch valve can be brought manually into the activated switch state or into the deactivated switch state.

According to a further embodiment of the dishwasher, the control apparatus is configured to carry out a plausibility check of an assignment of a switch state to a stored earlier differential value as a function of the predetermined class differential value and a difference between the earlier differential value and the current differential value.

For example, in the deactivated state a reduction of the differential value by the class differential value is expected in the event of a switchover to the activated switch state, and vice versa. An increase in the differential value is expected only if the switch state remains the same, wherein only small changes are expected. If a significant increase which is greater than a predetermined threshold value, in particular greater than the class differential value, is ascertained, the plausibility can be checked. For example, the user is prompted to verify the current switch state. Alternatively or in addition, a new calibration wash cycle can be carried out under the user's control in order to ascertain a new reference value for the switch state.

According to a further embodiment of the dishwasher, the control apparatus is configured to operate the pump facility at a predetermined rotational speed during the detection of the first and second pump flow.

According to a second aspect, a method for operating a dishwasher, in particular a household dishwasher, is proposed. The dishwasher comprises a control apparatus for carrying out a washing program for washing items to be washed arranged in a washing compartment of the dishwasher, and a first spray apparatus and a second spray apparatus, which can selectively be supplied with washing liquor via a pump facility in order to embody a respective washing zone. An intensive spray apparatus is also present, which is assigned to the first or the second spray apparatus and can be brought into an activated or deactivated state by means of a switch valve. In a first step, a first pump flow is detected while the first spray apparatus is being supplied with washing liquor. In a second step, a second pump flow is detected while the second spray apparatus is being supplied with washing liquor. In a third step, a current differential value is formed as a function of the detected first and second pump flow. In a fourth step, a current switch state of the intensive spray apparatus is ascertained as a function of the current differential value, a number of stored earlier differential values, and a predetermined class differential value. In a fifth step, the washing program is adapted as a function of the ascertained current switch state.

The method is preferably carried out with a dishwasher according to the first aspect.

The method has the same advantages as explained for the dishwasher of the first aspect. The embodiments and features described for the proposed dishwasher apply correspondingly to the proposed method.

According to one embodiment of the method, the intensive spray apparatus is in a predetermined switch state the first time the washing program is carried out with the dishwasher.

According to a third aspect, a computer program product is proposed which comprises commands which, on execution of the program by a computer, cause the computer to carry out the method according to the second aspect.

A computer program product, such as for example a computer program means, can for example be provided or supplied as a storage medium such as for example a memory card, USB stick, CD-ROM or DVD, or also in the form of a file which can be downloaded from a server in a network. This can take place for example in a wireless communications network through the transmission of a corresponding file with the computer program product or the computer program means.

Further possible implementations of the invention also comprise combinations—not explicitly cited—of features or embodiments described above or below in respect of the exemplary embodiments. In this context, the person skilled in the art will also add individual aspects as improvements or enhancements to the respective basic form of the invention.

BRIEF DESCRIPTION OF THE DRAWINGS

Further advantageous embodiments and aspects of the invention form the subject matter of the subclaims and of the exemplary embodiments of the invention that are described below. The invention is described below in greater detail on the basis of preferred embodiments with reference to the attached figures.

DETAILED DESCRIPTION OF EXEMPLARY EMBODIMENTS OF THE PRESENT INVENTION

Figure 1:
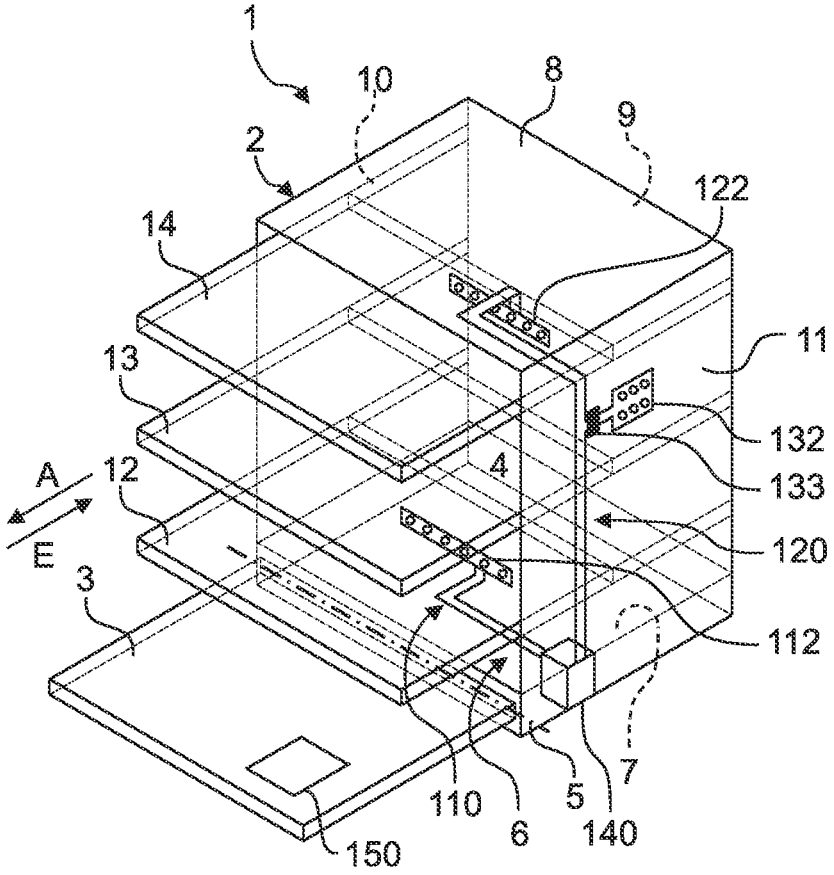
FIG. 1 shows a schematic perspective view of an exemplary embodiment of a dishwasher.

In the figures, elements that are identical or have the same function are provided with the same reference characters unless otherwise stated.

FIG. 1 shows a schematic perspective view of an embodiment of a dishwasher 1. The dishwasher 1 is embodied here as a household dishwasher 1. The household dishwasher 1 comprises a dishwasher cavity 2, which can be closed by a door 3, in particular in a watertight manner. A sealing facility can be provided for this purpose between the door 3 and the dishwasher cavity 2 (not shown). The dishwasher cavity 2 is preferably cuboid in shape. The dishwasher cavity 2 can be arranged in a housing of the household dishwasher 1. The dishwasher cavity 2 and the door 3 can form a washing compartment 4 for washing items to be washed.

The door 3 is shown in its opened position in FIG. 1. The door 3 can be closed or opened by pivoting about a pivot axis 5 provided on a lower end of the door 3. A loading opening 6 of the dishwasher cavity 2 can be closed or opened with the aid of the door 3. The dishwasher cavity 2 has a base 7, a ceiling 8 arranged opposite to the base 7, a rear wall 9 arranged facing the closed door 3, and two side walls 10, 11 arranged facing one another. The base 7, the ceiling 8, the rear wall 9 and the side walls 10, 11 can be manufactured from a stainless-steel sheet, for example. Alternatively, the base 7 can be manufactured from a plastic material, for example.

Furthermore, the household dishwasher 1 has at least one receptacle for items to be washed 12, 13, 14. Preferably, a plurality of receptacles for items to be washed 12, 13, 14, for example three, can be provided, wherein the receptacle for items to be washed 12 can be a lower receptacle for items to be washed or a lower basket, the receptacle for items to be washed 13 can be an upper receptacle for items to be washed or an upper basket, and the receptacle for items to be washed 14 can be a cutlery drawer. As additionally shown in FIG. 1, the receptacles for items to be washed 12, 13, 14 are arranged one above the other in the dishwasher cavity 2. Each receptacle for items to be washed 12 to 14 is optionally able to be shifted into or out of the dishwasher cavity 2. In particular, each receptacle for items to be washed 12, 13, 14 is able to be inserted into the dishwasher cavity 2 in an insertion direction E and extracted from the dishwasher cavity 2 in an extraction direction A opposite to the insertion direction E.

In addition, the household dishwasher 1 has a first hydraulic arrangement 110 with a first spray apparatus 112, which is embodied as a spray arm, a second hydraulic arrangement 120 with a second spray apparatus 122, which is also embodied as a spray arm, and an intensive spray apparatus 132 which is assigned to the second spray apparatus 122. The intensive spray apparatus 132 is thus a component of the second hydraulic arrangement 120. The first spray arm 112 is arranged on the base 7 of the dishwasher cavity 2, the second spray arm 122 is arranged on the ceiling 8 of the dishwasher cavity 2, and the intensive spray apparatus 132, which is embodied as a number of spray nozzles, is arranged on the side wall 9 of the dishwasher cavity 2. A pump facility 140 is configured to supply the first spray apparatus 112 and the second spray apparatus 112 and optionally the intensive spray apparatus 132 with washing liquor F (see FIG. 2), wherein the washing liquor F is pumped through the respective hydraulic arrangement 110, 120. A switch valve 133 is arranged in the supply line to the intensive spray apparatus 132 and is configured to open or close the supply line. The intensive spray apparatus 132 is in an activated switch state when the switch valve 133 is open, and the intensive spray apparatus 132 is in a deactivated switch state when the switch valve 133 is closed.

A control apparatus 150 is also shown, which is arranged on the door 3 of the household dishwasher 1. The control apparatus 150 is configured in particular to detect a pump flow 142 (see FIG. 3) for operating the pump facility 140. By the control apparatus 150 detecting the pump flow 142 while the first spray apparatus 112 is being supplied with washing liquor F and while the second spray apparatus 122 is being supplied with washing liquor F, forming a current differential value ΔI0 (see FIG. 4 or 5), and comparing this with stored earlier differential values ΔI1-ΔI8 (see FIG. 4 or 5), the control apparatus 150 can ascertain the current switch state of the intensive spray apparatus 132.

Figure 2:
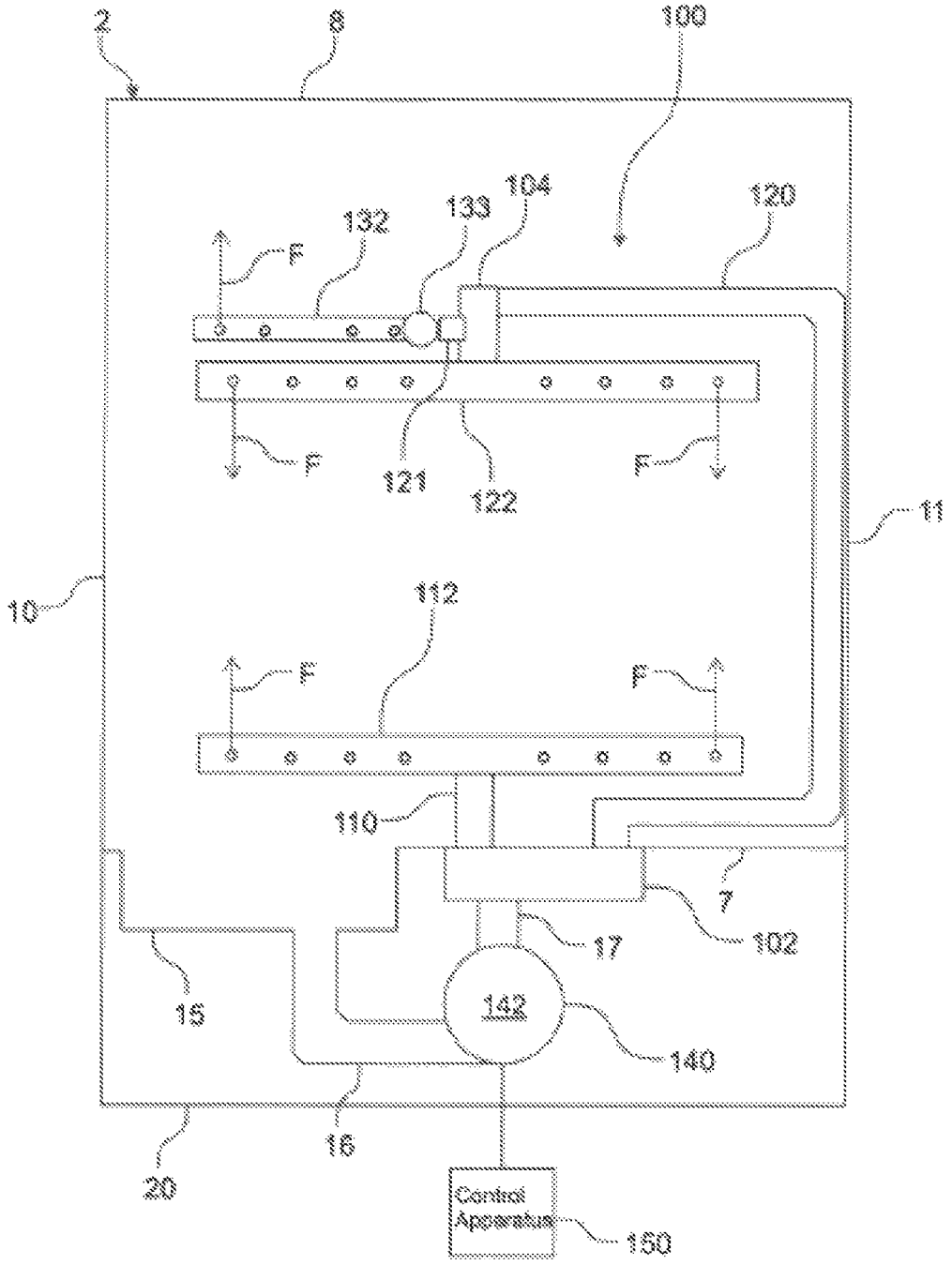
FIG. 2 shows a highly simplified schematic view of a further exemplary embodiment of a dishwasher.

FIG. 2 shows a highly schematic view of a further embodiment of a dishwasher 1, which is embodied here as a household dishwasher. In the following, only differences from the household dishwasher according to FIG. 1 will be considered.

A pump sump 15 is provided on the base 7. The pump facility 140 is arranged on the pump sump 15. The pump facility 140 can be connected to the pump sump 15 with the aid of a supply line 16, for example. A water switch 102 is provided downstream of the pump facility 140. The water switch 102 is coupled to the pump facility 140 with the aid of a supply line 17, for example. As well as the dishwasher cavity 2, the household dishwasher 1 comprises a base support 20, which supports the dishwasher cavity 2. The base support 20 is for example a plastic component, in particular a plastic injection-molded component.

In addition, the household dishwasher 1 has a hydraulic circuit 100, which comprises the first hydraulic arrangement 110 with the first spray apparatus 112 and the second hydraulic arrangement 120 with the second spray apparatus 122. The first spray apparatus 112 is embodied as a rotatably mounted spray arm in the dishwasher cavity 2, which spray arm is assigned for example to the lower receptacle for items to be washed 12 (see FIG. 1). The second spray apparatus 122 is also embodied as a spray arm provided rotatably in the dishwasher cavity 2, which spray arm is assigned for example to the middle receptacle for items to be washed 13 (see FIG. 1). Each spray apparatus 112, 122 comprises a multiplicity of spray nozzles for the even distribution of fresh water and/or washing liquor F in the dishwasher cavity 2.

The spray apparatus 112 is coupled to the water switch 102 by means of a supply line of the first hydraulic arrangement 110. The spray apparatus 122 is coupled to the water switch 102 by means of a supply line of the second hydraulic arrangement 120. With the aid of the water switch 102, it is possible for example to supply either only the first spray apparatus 112, only the second spray apparatus 122 or both spray apparatuses 112, 122 simultaneously with fresh water and/or washing liquor F while a washing program is running.

The hydraulic circuit 100 also comprises an intensive spray apparatus 132, which in this example is assigned to the second spray apparatus 122. The intensive spray apparatus 132 likewise comprises a multiplicity of spray nozzles. The intensive spray apparatus 132 can be fastened to the receptacle for items to be washed 13, for example. The intensive spray apparatus 132 is coupled fluidically to the pump facility 140 via the supply line of the second hydraulic arrangement 120. Here, however, a switch valve 133 is provided between the supply line 120 and the intensive spray apparatus 132, with the aid of which the intensive spray apparatus 132 can be decoupled from the hydraulic circuit 100 or deactivated and recoupled thereto or reactivated. The switch valve 133 can in particular be operated manually by a user such that the latter can deactivate and activate the intensive spray apparatus 132.

In this example, a closure 121 made from a water-soluble material is provided upstream of the switch valve 133. The closure 121 can be provided on or in a distribution element 104, which is suitable for distributing the fresh water and/or the washing liquor F onto the spray apparatuses 122, 132. The closure 121 can however also be provided downstream of the valve 133. Here, "upstream" means arranged before the valve 133 when viewed in a flow direction of the fresh water and/or washing liquor F. Here, "downstream" means arranged after the valve 133 when viewed in the flow direction of the fresh water and/or washing liquor F. During initial commissioning of the household dishwasher 1, the closure 121 serves to ensure that the intensive washing apparatus 132 is in the deactivated switch state, irrespective of the switch position of the switch valve 133. The intensive spray apparatus 132 is therefore in a predetermined reference switch state, which makes it possible to carry out a calibration measurement for the first pump flow I0 (see FIG. 3) and the second pump flow I1, I2 (see FIG. 3). The closure 121 dissolves during or after the first washing program cycle, so that in subsequent washing program cycles the position of the switch valve 133 defines the switch state of the intensive spray apparatus 132. The switch state can be ascertained by the control apparatus 150 as explained in detail below on the basis of FIG. 3-5, for example.

Figure 3:
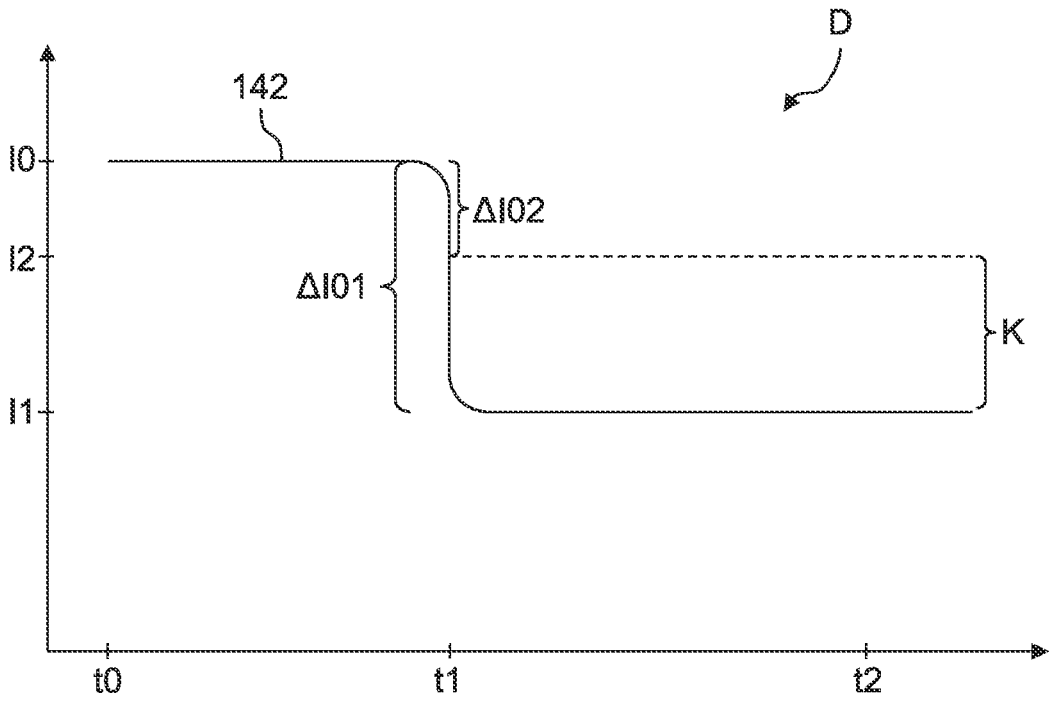
FIG. 3 shows a diagram with exemplary flow measured values.

FIG. 3 shows a schematic exemplary diagram D of a pump flow 142 over a time period from a start time t0 to an end time t2. The pump flow 142 shown is detected for example during the operation of a household dishwasher 1 from FIG. 1 or FIG. 2. At a switchover time t1, which lies between the start time t0 and the end time t2, a water switch 102 (see FIG. 2) is for example switched over such that the second spray apparatus 122 (see FIG. 1 or 2) is now supplied with washing liquor F (see FIG. 2) instead of the first spray apparatus 112 (see FIG. 1 or 2). This means that washing liquor F is supplied to the first spray apparatus 112 during the time period t0-t1 and to the second spray apparatus 122 during the time period t1-t2.

The pump flow 142 is plotted on the y axis of the diagram D. In particular, three values I0, I1 and I2 are marked. In this example, I0 corresponds for example to the pump flow 142 which is required while the first spray apparatus 112 is being supplied with washing liquor F. This pump flow 142 can also be referred to as the first pump flow I0. I1 corresponds for example to the pump flow 142 which is required while the second spray apparatus 122 is being supplied, when the intensive spray apparatus 132 (see FIG. 1 or 2) is in the deactivated switch state, in other words the switch valve 133 (see FIG. 1 or 2) is closed. I2 corresponds for example to the pump flow 142 which is required while the second spray apparatus 122 is being supplied, when the intensive spray apparatus 132 is in the activated switch state, in other words the switch valve 133 is open. The intensive spray apparatus 132 is thus also supplied with washing liquor F. I1 and I2 can in each case be referred to as the second pump flow.

The diagram D shows how the pump flow 142 changes at the switchover time t1 upon switchover from the first spray apparatus 112 to the second spray apparatus 122. The two possibilities regarding the current switch state of the intensive spray apparatus 132 are shown here, wherein the solid line shows the pump flow 142 in the deactivated switch state and the dashed line shows the pump flow 142 in the activated switch state. It can be seen that the pump flow 142 is different in the two switch states. Furthermore, for each switch state, the difference between the first pump flow I0 and the second pump flow I1, I2 is indicated as Δ101, Δ102. The difference between the two possible values of the second pump flow I1, I2 is indicated as K. K is also referred to as the class differential value. The class differential value K is substantially constant for a predetermined hydraulic circuit 100 (see FIG. 2). Changes in the class differential value K can occur for example on account of a soiling of individual spray nozzles of the spray apparatuses 112, 122, 132.

The control apparatus 150 (see FIG. 1) is in particular configured to determine the current differential value Δ101, Δ102 and, on the basis of a comparison with stored earlier differential values ΔI1-ΔI8 (see FIG. 4 or 5) and the predetermined class differential value K, to ascertain the current switch state of the intensive spray apparatus 132. This is explained in more detail below by way of example with reference to FIGS. 4 and 5.

Figure 4:
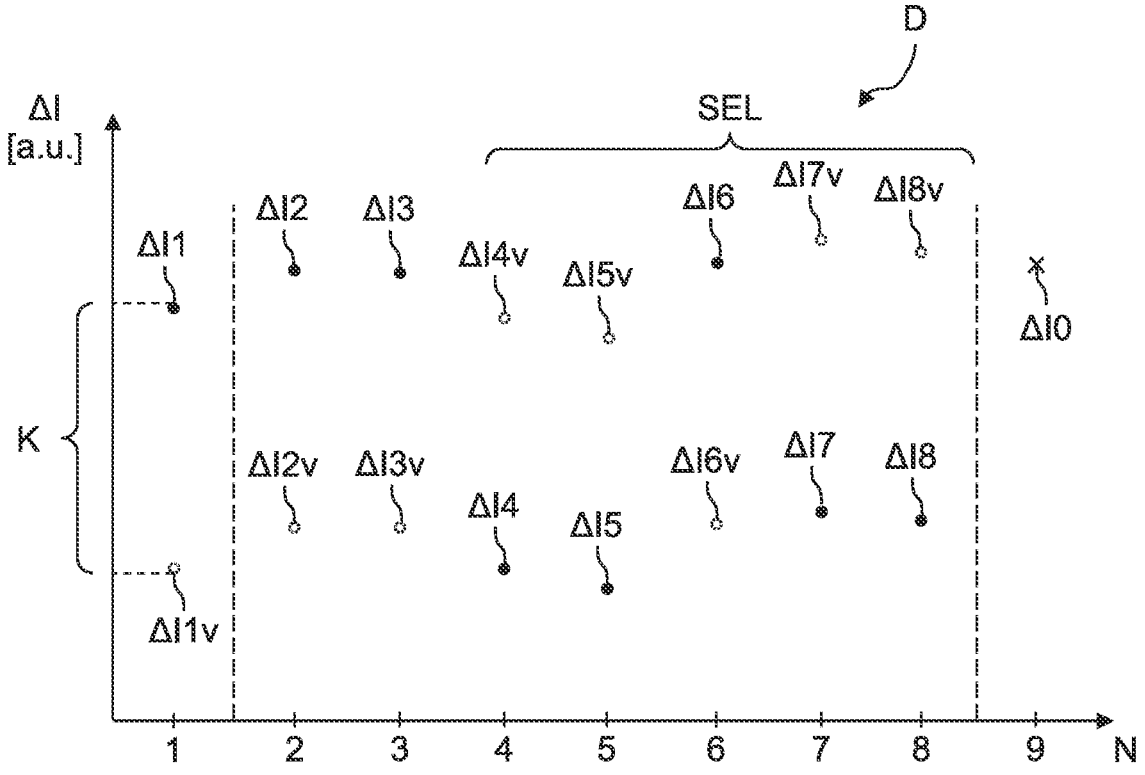
FIG. 4 shows a diagram with exemplary differential values.

FIG. 4 shows a diagram D with exemplary differential values ΔI1-ΔI8, which were detected and stored when washing programs were carried out. The horizontal axis shows the number of the washing program cycle N. The vertical axis shows the differential value ΔI1-ΔI8 ascertained in each case in arbitrary units (a.u.). Diagram D also shows corresponding virtual differential values ΔI1*v*-ΔI8*v* for each of the differential values ΔI1-ΔI8. Depending on the switch state, the respective virtual differential value ΔI1*v*-ΔI8*v* corresponds to the difference between or the sum of the corresponding differential value ΔI1-ΔI8 and the class differential value K. The first washing program cycle N=1 was carried out with a predetermined reference switch state, such as is explained by way of example on the basis of FIG. 2, wherein the virtual differential value ΔI1*v* corresponds to the difference between the differential value ΔI1 and the class differential value K.

During the subsequent washing program cycles, N=2-N=8, the current differential value ΔI0, which corresponds to the difference ΔI01 or ΔI02 from FIG. 3 depending on the switch position, was in each case ascertained and stored. Furthermore, the respective switch state was ascertained on the basis of the current differential value ΔI0 by comparison with stored earlier differential values. It can be seen that slight fluctuations of the respective differential value with the same switch position can occur, which can be caused for example by a soiling load in the washing liquor F and/or a soiling of the spray apparatuses 112, 122, 132.

During the fourth washing program cycle, N=4, for example, the switch state was switched over, for example from deactivated to activated, so that the virtual differential value ΔI4*v* in this case corresponds to the sum of the differential value ΔI4 and the class differential value K.

The ninth washing program cycle, N=9, is currently being carried out. The current switch state is unknown. The current differential value ΔI0 was ascertained on the basis of the first pump flow I0 (see FIG. 3) and the second pump flow I1, I2 (see FIG. 3). The control apparatus 150 (see FIG. 1 or 2) loads a selection SEL comprising the stored earlier differential values ΔI4-ΔI8 or value pairs of the last five washing program cycles (N=4-8).

If only individual values are stored, the respective switch state is preferably stored with the individual value. The value pairs can then be formed from the individual values and the class differential value K. If value pairs are stored, the switch state of a respective value results from its relationship with the further value in the value pair, so that it is not absolutely necessary for the switch state also to be stored.

Figure 5:
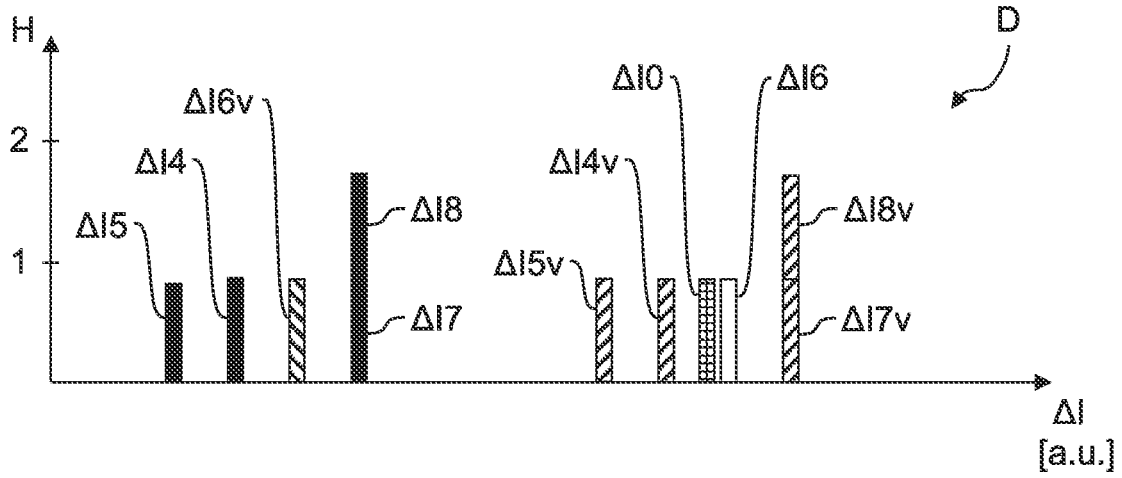
FIG. 5 shows a diagram with an exemplary frequency distribution.

The control apparatus 150 ascertains for example a frequency distribution, as shown by way of example in FIG. 5. Here, all individual values ΔI4-ΔI8, ΔI4*v*-ΔI8*v* contained in the selection SEL of the five value pairs are entered in the diagram D in accordance with their amount. In FIG. 5, the filled bars show the differential values ΔI4, ΔI5, ΔI7, ΔI8 in the activated state, the empty bars show the differential value ΔI6 in the deactivated state, and the hatched bars ΔI4*v*, ΔI5*v*, ΔI6*v*, ΔI7*v*, ΔI8*v* correspond to the virtual differential values having the respective other switch state.

Starting from this frequency distribution, the control apparatus 150 ascertains the five nearest values to the current differential value ΔI0, which is shown with a different hatching. In this example, these are ΔI4*v*, ΔI5*v*, ΔI6, ΔI7*v* and ΔI8. The control apparatus 150 now ascertains the frequency of the activated switch state and of the deactivated switch state in the nearest values. In this example, the deactivated switch state is ascertained five times and the activated switch state not at all. The control apparatus 150 thus ascertains that the current switch state is the deactivated switch state.

The procedure described with reference to FIGS. 4 and 5 can be expressed in terms of a mathematical formula for example as follows. Let there be the value pairs (X1, Y1), . . . ,(Xn,Yn), wherein an Xi is a stored earlier differential value and Yi the associated switch state, Yi=0 for the deactivated switch state and Yi=1 for the activated switch state. Let the value pairs (X1', Y1'), . . . ,(Xn',Yn') be resorted such that with X* (current differential value) the series $X1'-X^*<X2'-X^*< \ldots <Xn'-X^*$ applies. Let k be an odd integer. If $1/k \cdot \Sigma Yi' > 0.5$, wherein the sum is formed over the values of i=1−k, then Y*=1, otherwise Y*=0.

As an alternative to the procedure outlined, the control apparatus 150 can be configured to ascertain a mean value of the differential values with the activated switch state and a mean value of the differential values with the deactivated switch state and to ascertain the current switch state on the basis of the distance between the current differential value and the mean values. Here, the respective mean value is formed on the basis of the same number of stored earlier differential values. However, it is not absolutely necessary to store the value pairs, but instead the virtual differential value corresponding to a differential value can also be formed only during the calculation of the mean value and be included in the mean value.

Figure 6:
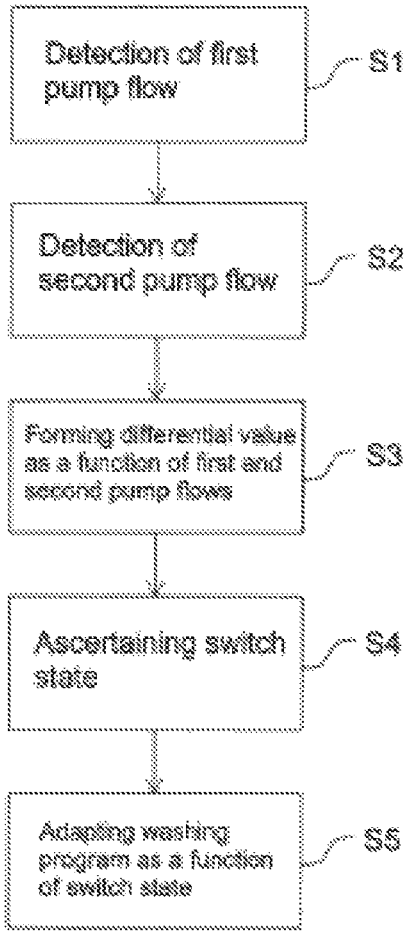
FIG. 6 shows a schematic block diagram of an exemplary embodiment of a method for operating a dishwasher.

FIG. 6 shows a schematic block diagram of an exemplary embodiment of a method for operating a dishwasher 1, for example the household dishwasher from FIG. 1 or 2.

In a first step S1, a first pump flow I0 (see FIG. 3) is detected while a first spray apparatus 112 (see FIG. 1 or 2) is being supplied with washing liquor F (see FIG. 2). In a second step S2, a second pump flow $I_1$, $I_2$ is detected while a second spray apparatus 122 (see FIG. 1 or 2) is being supplied with washing liquor F. In a third step S3, a current differential value ΔI0 (see FIG. 4 or 5) is formed as a function of the detected first and second pump flow I0, I1, I2 (see FIG. 3). In a fourth step S4, a current switch state of the intensive spray apparatus 132 (see FIG. 1 or 2) is ascertained as a function of the current differential value ΔI0, a number of stored earlier differential values ΔI1-ΔI8 (see FIG. 4 or 5) and a predetermined class differential value K (see FIG. 3 or 4). In a fifth step S5, the washing program is adapted as a function of the ascertained current switch state. For example, a pump rotational speed is changed and/or the quantity of washing liquor is adapted.

Although the present invention has been described with reference to exemplary embodiments, it can be modified in numerous different ways.

The concept described can therefore be extended to include a greater number of spray apparatuses and/or more than one intensive spray apparatus. One condition is that at least one of the spray apparatuses has a known or automatically ascertainable switch state, in particular has no assigned connectable intensive spray apparatus. The differential value for a respective spray apparatus is always ascertained in relation to the spray apparatus with the known switch state.

For example, the dishwasher also has a third spray apparatus with an intensive spray apparatus which can be connected selectively. The same approach as described above can be used for the third spray apparatus.

Alternatively or in addition, the spray apparatus with an assigned intensive spray apparatus can have a further intensive spray apparatus. It can then be provided that only one of the two intensive spray apparatuses can be activated. Alternatively, it can be provided that the two intensive spray apparatuses are selectively activated individually or together. Here, a plurality of class differential values is preferably provided, each of which describes a corresponding difference between the activated and deactivated switch state.

The invention claimed is:

1. A dishwasher, comprising:

a first spray apparatus;

a second spray apparatus;

a pump facility configured to selectively supply washing liquor to the first and second spray apparatuses to embody washing zones, respectively;

an intensive spray apparatus assigned to the first spray apparatus or the second spray apparatus;

a switch valve configured to bring the intensive spray apparatus into an activated or deactivated state; and a control apparatus configured to carry out a washing program for washing items to be washed arranged in a washing compartment of the dishwasher, said control apparatus configured to detect a first pump flow while the first spray apparatus is being supplied with washing liquor and to detect a second pump flow while the second spray apparatus is being supplied with washing liquor, to form a current differential value as a function of the first pump flow and the second pump flow, to store at least one earlier differential value with a switch state assigned to the earlier differential value, to ascertain a current switch state of the intensive spray apparatus as a function of the current differential value, the at least one earlier differential value, and a predetermined class differential value, and said control apparatus configured to adapt the washing program as a function of the ascertained current switch state.

2. The dishwasher of claim 1, embodied as a household dishwasher.

3. The dishwasher of claim 1, wherein the intensive spray apparatus is in a predetermined switch state when the washing program is carried out a first time with the dishwasher.

4. The dishwasher of claim 1, wherein the control apparatus is configured to store at least one of the earlier differential values with a switch state assigned to the at least one of the earlier differential values.

5. The dishwasher of claim 1, wherein the control apparatus is configured to store the current differential value together with the current switch state.

6. The dishwasher of claim 1, wherein the control apparatus is configured to ascertain the current switch state based on the stored earlier differential values of preceding N washing programs being carried out, wherein N is a natural number from a range [0,100].

7. The dishwasher of claim 1, wherein the control apparatus is configured to ascertain a virtual differential value based on the current differential value and the current switch state, wherein the virtual differential value corresponds to a difference between the current differential value and the predetermined class differential value in the activated switch state of the intensive spray apparatus, and corresponds to a sum of the current differential value and the predetermined class differential value in the deactivated switch state of the intensive spray apparatus, wherein the control apparatus is configured to store a value pair comprising the current differential value and the virtual differential value.

8. The dishwasher of claim 7, wherein the predetermined class differential value for ascertaining the virtual differential value comprises a first value for the activated switch state and a second value for the deactivated switch state.

9. The dishwasher of claim 7, wherein the control apparatus is configured to store a number of value pairs and to ascertain the current switch state as a function of the number of stored value pairs, wherein the control apparatus is configured to determine an upper mean value which is a mean value of respectively higher values of the number of stored value pairs and to determine a lower mean value which is a mean value of respectively lower values of the number of stored value pairs, and wherein the control apparatus is configured to compare the current differential value with the upper mean value and the lower mean value.

10. The dishwasher of claim 7, wherein the control apparatus is configured to store a selection of value pairs and to ascertain the current switch state as a function of the selection of stored value pairs, wherein the control apparatus is configured to ascertain a number of nearest values of all values comprised by the selection of stored value pairs, and wherein the control apparatus is configured to ascertain a frequency of the activated switch state and a frequency of the deactivated switch state based on the number of nearest values.

11. The dishwasher of claim 1, wherein the switch valve is configured for manual operation by a user of the dishwasher to set the switch state of the intensive spray apparatus.

12. The dishwasher of claim 1, wherein the control apparatus is configured to carry out a plausibility check of an assignment of a switch state to a stored earlier differential value as a function of the predetermined class differential value and a difference between the earlier differential value and the current differential value.

13. The dishwasher of claim 1, wherein the control apparatus is configured to operate the pump facility at a predetermined rotational speed during detection of the first and second pump flows.

14. A method for operating a dishwasher, said method comprising:

detecting a first pump flow while a first spray apparatus of the dishwasher is being supplied via a pump with washing liquor for embodying a washing zone;

detecting a second pump flow while a second spray apparatus of the dishwasher is being supplied via the pump with washing liquor for embodying another washing zone;

forming a current differential value as a function of the first pump flow and second pump flow;

storing at least one earlier differential value with a switch state assigned to the earlier differential value;

ascertaining a current switch state of an intensive spray apparatus of the dishwasher as a function of the current differential value, the at least one earlier differential value, and a predetermined class differential value; and adapting a washing program for washing items to be washed in a washing compartment of the dishwasher as a function of the ascertained current switch state.

15. The method of claim 14 operating a household dishwasher.

16. The method of claim 14, wherein the intensive spray apparatus is in a predetermined switch state, when a washing program is carried out a first time with the dishwasher.

17. A computer program product embodied on a non-transitory computer readable medium comprising commands which when executed by a computer, cause the computer to carry out a method as set forth in claim 14.

* * * * *